US007359669B2

(12) United States Patent
Kitano

(10) Patent No.: US 7,359,669 B2
(45) Date of Patent: Apr. 15, 2008

(54) FIXING MEMBER, FIXING APPARATUS AND FIXING METHOD

(75) Inventor: Yuji Kitano, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/169,788

(22) Filed: Jun. 30, 2005

(65) Prior Publication Data

US 2006/0008304 A1 Jan. 12, 2006

(30) Foreign Application Priority Data

Jul. 9, 2004 (JP) ..... 2004-203552

(51) Int. Cl.
*G03G 15/20* (2006.01)

(52) U.S. Cl. ..... 399/333; 430/124.1

(58) Field of Classification Search ..... 399/333; 430/124.1

See application file for complete search history.

(56) References Cited

U.S. PATENT DOCUMENTS

| | | | | |
|---|---|---|---|---|
| 5,910,544 | A * | 6/1999 | Ozawa et al. | 525/178 |
| 5,960,245 | A * | 9/1999 | Chen et al. | 399/333 |
| 5,969,066 | A | 10/1999 | Enokida et al. | 526/247 |
| 6,321,062 | B1 * | 11/2001 | Kitano et al. | 399/333 |
| 6,377,777 | B1 | 4/2002 | Kishino et al. | 399/329 |
| 6,424,815 | B1 | 7/2002 | Kawamoto et al. | 399/325 |
| 6,459,878 | B1 | 10/2002 | Tomoyuki et al. | 399/331 |
| 6,546,223 | B2 | 4/2003 | Kishino et al. | 399/333 |
| 6,673,407 | B2 * | 1/2004 | Hara et al. | 428/36.9 |
| 7,173,092 | B2 * | 2/2007 | Gornowicz et al. | 525/104 |
| 2004/0175526 | A1 * | 9/2004 | Corveleyn et al. | 428/36.91 |
| 2006/0008304 | A1 | 1/2006 | Kitano | 399/333 |

FOREIGN PATENT DOCUMENTS

| | | | |
|---|---|---|---|
| JP | 06308848 | A * | 11/1994 |
| JP | 09096981 | A * | 4/1997 |
| JP | 3055119 | | 4/2000 |
| JP | 2000-242115 | | 9/2000 |

OTHER PUBLICATIONS

Organics Chemistry, Second Ed., John McMurray, Brooks/ Cole Publishing Co, Pacific Grove, California, 1998, p. 1123.*

Zheng Wei, *Applications of Silicone Surfactants*, World Refining, 2002, p. 12.

Chinese Office Action dated Dec. 7, 2007, issued in corresponding Chinese patent application No. 2005100828200, with a partial English-language translation.

* cited by examiner

*Primary Examiner*—David M. Gray
*Assistant Examiner*—Bryan Ready
(74) *Attorney, Agent, or Firm*—Fitzpatrick, Cella, Harper & Scinto

(57) ABSTRACT

A fixing member has a support and a surface layer, wherein the surface layer is a rubber mold-releasing layer containing a mixture of a fluorocarbon rubber and dimethyl silicone rubber, the rubber mold-releasing layer has an island-in-sea structure, the dimethyl silicone rubber stands as an island phase, the fluorocarbon rubber stands as a sea phase, the island phase is a dispersion phase and the sea phase is a continuous phase, an average particle diameter of the island phase in the sectional plane of the rubber mold-releasing layer is 20 μm or less and the combining proportion of the fluorocarbon rubber and the dimethyl silicone rubber falls within a range of 20:80 to 80:20 in terms of a volume proportion.

17 Claims, 2 Drawing Sheets

FIXING MEMBER, FIXING APPARATUS AND FIXING METHOD

BACKGROUND OF THE INVENTION

1. Field of the Invention

The present invention relates to a fixing member which is used in the field of fixing technology for electrophotographic image forming apparatus such as a photocopier as well as LBP, and which has a rubber based mold-releasing layer and capable of fixing a toner onto a recording material especially in an oilless system, a fixing apparatus and a fixing method.

2. Related Background Art

A fixing member is incorporated into an electrophotographic image forming apparatus in order to heat and fix a toner image formed on a recording material (hereinafter also to be referred to as a transfer material) such as paper. Such fixing member is required to have a toner mold-releasing property. A toner mold-releasing property means to what extent a toner will not be attached to the surface of a fixing member when to bring a toner image formed electrostatically onto the recording material into fixing with heat and pressure. When a toner offset, that is, attachment of toner onto the surface of fixing member, takes place, partial lacking in the toner image formed on the recording material takes place or offset toner is refixed onto the subsequent recording material to occasionally give rise to a problem to worsen the image. Accordingly, use of a material excellent in toner releasing property on the surface of the fixing member, that is, a mold-releasing layer, is important as properties of the member.

As such a fixing member, the one with at least one mold-releasing layer being formed on the outer periphery of the cylindrical axis body and the mold-releasing layer of which is formed with a fluorocarbon resin is generally being used. The surface energy of a fluorocarbon resin is low and non-adhesive and excellent in a mold-releasing property. However, since it is a resin, its hardness is intensive, and at the time when the toner image formed electrostatically is brought into fixing with heat and pressure, the toner particles more than necessary in number are crushed, resulting in fine lines extending and overlapping, making high quality image hardly obtainable such as by occasionally making small letters difficult to be read and the like.

In contrast thereto, those whose mold-releasing layer is formed with rubber being an elastic body is more flexible compared with resins and do not crush toner particles more than necessary, and is advantageous in readily giving rise to a quality image. However, in general a rubber provides higher surface energy compared with a fluorocarbon resin and occasionally is inferior in a toner mold-releasing property. In particular, as for color oilless fixing, it is only fluorocarbon resins that are available for practical use as a material for a mold-releasing layer but no fixing members comprising a mold-releasing layer containing rubber (hereinafter also to be referred to as "rubber mold-releasing layer") have been realized yet for practical use to date. In order to obtain quality images, a mold-releasing layer containing flexible rubber is being desired instead of a mold-releasing layer containing hard resin.

Since a fixing member is used under a high temperature around 200° C., a rubber for a mold-releasing layer is required to be heat resistant. Such a heat resistant rubber type includes fluorocarbon rubbers and silicone rubbers.

A fluorocarbon rubber is a rubber being an elastic body by adding a cross-linking agent, cross-linking auxiliary agent or reinforcing combination preparation and the like to various kinds of fluorocarbon rubber polymers (hereinafter also to be referred to as fluoropolymer) configured by comprising a partially fluorinated hydrocarbon chain to form a three-dimensional network by cross-linking such as cross-linking by a polyamine, cross-linking by a polyol or cross-linking by an organic peroxide.

So far, a fluorocarbon rubber is mainly used as a mold-releasing layer of an oil coating system for supplying a color apparatus with degenerative silicone oil from outside. As types of fluoropolymer, those fluoropolymers configured by comprising vinylidene fluoride-hexafluoropropylene copolymer, or vinylidene fluoride-hexafluoropropylene-tetrafluoroethylene terpolymer subject to combination with metal containing filler or reinforcing filler and thereafter brought into polyamine cross-linking or polyol cross-linking are mainly used.

In addition, a silicone rubber refers to a rubber being an elastic body by compounding various kinds of fillers corresponding with a necessity with a raw rubber such as a polymer configured by methylvinyl siloxane or methylphenylvinyl siloxane unit subject to substitution of a part of a methyl group with a phenyl group to form a three-dimensional network by cross-linking such as an addition reaction cross-linking or cross-linking by an organic peroxide. In general, being excellent in heat resistance, a silicone rubber is mainly used as a heat conductive elastic layer for a bottom layer of a mold-releasing layer. In addition, as a mold-releasing layer, it has been mainly used as a mold-releasing layer of an oil coating system for supplying a color apparatus with dimethyl silicone oil from outside.

Recently, in order to ensure a mold-releasing property of toner, an oilless fixing system which does not undergo oil coating from outside as described above but adds a wax for extending mold-releasing assisting effects to inside toner particles is realized for practical use in a mold-releasing layer made of fluorocarbon resin.

In order to obtain a quality image, adoption of fluorocarbon rubber instead of fluorocarbon resin imparts a low affinity between the wax in the toner and the fluorocarbon rubber, and the wax does not extend its mold-releasing assisting effects sufficiently. That occasionally has given rise to paper twining or toner offset as a result of unseparation of toner from the mold-releasing layer. In addition, use of dimethyl silicone rubber as the mold-releasing layer imparts high affinity between the wax in the toner and the dimethyl silicone rubber, but too much affinity affects the toner mold-releasing property somehow adversely and, likewise in case of the fluorocarbon rubber, occasionally has given rise to paper twining or toner offset.

As for oilless fixing for a color apparatus, the Japanese Patent Application Laid-Open No. 2000-242115 has proposed an image recording apparatus, wherein a toner comprises toner particles containing at least a wax (hereinafter also referred to as wax-containing toner) and, in a fixing apparatus, a fixing member surface on the side in contact with an unfixed toner image comprises a mold-releasing layer configured by comprising a fluorocarbon rubber with high affinity with the wax. In addition, Japanese Patent No. 3055119 has proposed a fixing apparatus, wherein a toner comprises toner particles containing at least a binder resin, a colorant and a wax, the average molecule by weight (Mw) of the wax being 400 to 4000 and its average molecule by number (Mn) being 200 to 4000, and a mold-releasing layer disposed on the outest surface of a heat fixing member is formed by mixture of fluorocarbon rubber and tetrafluoroethylene-perfluoroalkylvinylether copolymer, and the contact angle of the mold-releasing layer with water is adjusted to fall within the range of 80 to 103°.

The above described Japanese Patent Application Laid-Open No. 2000-242115 has proposed a mold-releasing layer configured by comprising a fluorocarbon rubber having a high wax affinity, but further improvement in toner mold-releasing property is desired.

In addition, the above described Japanese Patent No. 3055119 has proposed a mold-releasing layer configured by mixture of fluorocarbon rubber and tetrafluoroethylene-perfluoroalkylvinylether copolymer for the purpose of refraining from deteriorating the affinity with a wax. However, this is not a single rubber body but a mixture of rubber and resin, flexibility of which occasionally may be low compared with a single rubber body.

SUMMARY OF THE INVENTION

An object of the present invention is to provide a fixing member which has a rubber mold-releasing layer excellent in a toner mold-releasing property without causing toner offset to a wax-containing toner used in an oilless fixing system. Another object of the present invention is to provide a fixing method as well as a fixing apparatus comprising such a fixing member.

The above described objects are attained by the following invention.

(1) A fixing member comprising a support and a surface layer, wherein the surface layer is a rubber mold-releasing layer containing a mixture of a fluorocarbon rubber and a dimethyl silicone rubber, the rubber mold-releasing layer has an island-in-sea structure, the dimethyl silicone rubber stands as an island phase, the fluorocarbon rubber stands as a sea phase, the island phase is a dispersion phase and the sea phase is a continuous phase, an average particle diameter of the island phase in the sectional plane of the rubber mold-releasing layer is 20 μm or less and the combining proportion of the fluorocarbon rubber to the dimethyl silicone rubber falls within a range of 20:80 to 80:20 in terms of a volume proportion. Dispersing dimethyl silicone rubber into fluorocarbon rubber enables an affinity with a wax to increase to an appropriate extent.

(2) The fixing member described in (1), wherein the fluorocarbon rubber is a vinylidene fluoride-tetrafluoroethylene-perfluoroalkylvinylether terpolymer.

(3) The fixing member described in (1), wherein the rubber mold-releasing layer further contains a silicone surfactant. Combination of the silicone surfactant having an affinity with both of the fluoropolymer and the dimethyl silicone rubber enables a dispersion property of the dimethyl silicone rubber into the fluoropolymer to increase.

(4) The fixing member described in (3), wherein the silicone surfactant has a polydimethyl siloxane unit and a polyoxyalkylen unit, and the polydimethyl siloxane unit and the polyoxyalkylen unit are alternately repeated. Use of the silicone surfactant having such a configuration can enhance the dispersion property increasing effects further.

(5) The fixing member described in (3), wherein a combining quantity of the silicone surfactant is 0.1% by weight to 5.0% by weight to the summed weight of the fluorocarbon rubber and the dimethyl silicone rubber. Adoption of this range can improve the dispersion property of the dimethyl silicone rubber.

(6) The fixing member described in (1), wherein both of the fluorocarbon rubber and the dimethyl silicone rubber in the rubber mold-releasing layer are subject to cross-linking by an organic peroxide. Cross-linking of the fluorocarbon rubber and the dimethyl silicone rubber can be unified so as to enable strength of the blended rubber to get intensified.

(7) The fixing member described in (6), wherein the cross-linking by the organic peroxide is implemented simultaneously to the fluorocarbon rubber and the dimethyl silicone rubber. Simultaneous cross-linking by the organic peroxide leads to cross-linking in the interfaces of the continuous phase and the dispersion phase as well so as to enable strength of the blended rubber to get intensified further.

(8) The fixing member described in (1), wherein the fixing member is a fixing roller.

(9) The fixing member described in (1), wherein the fixing member is a fixing belt.

(10) A fixing apparatus in an oilless system comprising a fixing member described in (1). Use of such a fixing apparatus makes a quality image obtainable.

(11) The fixing apparatus described in (10), wherein the fixing member is a fixing roller.

(12) The fixing apparatus described in (10), wherein the fixing member is a fixing belt.

(13) The fixing apparatus described in (10), wherein the fixing member comprises a fixing roller and a pressure roller.

(14) A fixing method in an oilless system comprising fixing a toner image onto a surface of a transfer material by a fixing apparatus described in (10). Use of such a fixing apparatus makes a quality image obtainable.

(15) The fixing method described in (14), wherein the fixing member is a fixing roller.

(16) The fixing method described in (14), wherein the fixing member is a fixing belt.

(17) The fixing method described in (14), wherein the fixing member comprises a fixing roller and a pressure roller.

Incorporating the fixing member of the present invention into a fixing apparatus for use will not give rise to paper twining or toner offset to a wax-containing toner in an oilless fixing system, and therefore the fixing member of the present invention is excellent in a toner mold-releasing property and flexibility. Accordingly, an electrophotographic image forming apparatus in an oilless fixing system, in which a fixing apparatus configured by incorporating the fixing member of the present invention therein is disposed, makes high quality toner image obtainable.

DETAILED DESCRIPTION OF THE PREFERRED EMBODIMENTS

Figure 1:
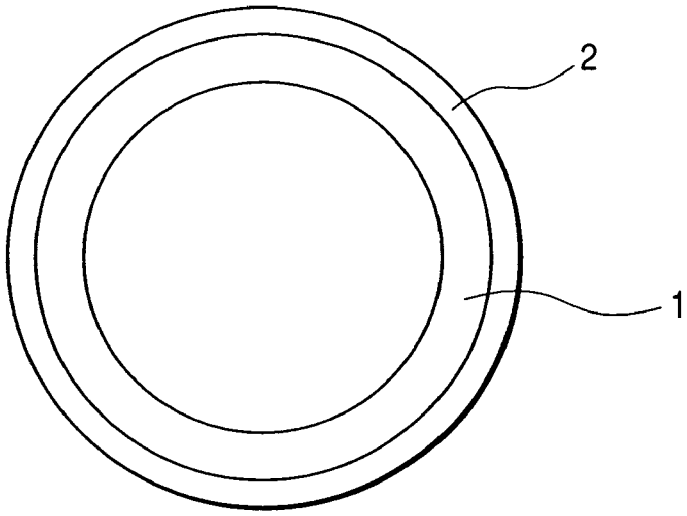
FIG. 1 is a sectional view of a fixing member in a single layer configuration.

It is considered that a dimethyl silicone rubber is brought into dispersion like islands (island-in-sea structure) as means for intensifying a wax affinity of a fluorocarbon rubber to an appropriate extent. Dispersion of a fluorocarbon rubber having a low affinity with a wax to a dimethyl silicone rubber having a high affinity with a wax can intensify the wax affinity of the fluorocarbon rubber. In addition, even if a dimethyl silicone rubber is dispersed into the fluorocarbon rubber like islands, such a case of the average particle diameter of the dispersion phase in the sectional plane of the rubber mold-releasing layer being over 20 μm is not desirable since a dimethyl silicone rubber does not exist on the rubber surface, occasionally failing in intensifying the wax affinity. In addition, in general, to a wax-containing toner with the average particle diameter being 10 μm or less, such a case of the average particle diameter of the dispersion phase in the sectional plane of the rubber mold-releasing layer being over 20 μm is not desirable since the wax affinity of the fluorocarbon rubber cannot be evenly intensified occasionally. In addition, from the point of view of readiness to treatment, the average particle diameter of the dispersion phase in the sectional plane as well as the surface of the rubber mold-releasing layer is preferably 1 μm or more.

In the present invention, the average particle diameter of the dispersion phase is measured as follows.

For respective particles forming dispersion phase in the sectional plane in the direction perpendicular to the rubber mold-releasing layer surface, the maximum diameter portion of a particle is fixed as a longitudinal direction, a short axis is newly set so as to provide equal particle area to set an oval shape, the calculated average value of the length of the long axis and the length of the short axis is defined as the particle diameter of that particle. Moreover, particle diameters of 100 particles selected at random are measured to obtain an average value which was defined as the average particle diameter of the dispersion phase in the sectional plane of the rubber mold-releasing layer. Here, the dispersion state of the fluorocarbon rubber and the dimethyl silicone rubber in the rubber mold-releasing layer was checked by implementing elemental mapping with a scanning electro microscope (SEM, made by Nihon Denshi Co., JSM-5910L V type) comprising an electro probe microanalyzer (EPMA) under acceleration voltage: 20 kV, measurement mode: highly vacuum mode, measurement magnification: 300, detector: energy dispersion type, and mapping element: F and Si. In addition, the average particle diameter of the dispersion phase in the surface of the rubber mold-releasing layer can be given with the similar measurement method.

The combining proportion of the fluorocarbon rubber to the dimethyl silicone rubber falls within the range of 20:80 to 80:20 in terms of volume ratio, and the volume proportion of the dimethyl silicone rubber being less than 20/100 is not desirable since affinity with a wax cannot be intensified sufficiently. In addition, the volume proportion of the dimethyl silicone rubber being over 80/100 is not desirable since affinity with a wax is occasionally intensified too much, influencing the toner mold-releasing property adversely.

Conventionally, as a trial to disperse a dimethyl silicone rubber into a fluorocarbon rubber, simple mixture of the dimethyl silicone rubber into the fluorocarbon rubber results in coarse dispersion state due to a low affinity between the both parties, frequently ending in the particle diameter of the dispersion phase in the sectional plane of the rubber mold-releasing layer being in the order of several hundred μm. Therefore, in the present invention, as a polymer type of a fluorocarbon rubber, vinylidene fluoride-tetrafluoroethylene-perfluoroalkylvinylether terpolymer having an ether group was selected, and a silicone surfactant having a affinity to the both of this fluoropolymer and the dimethyl silicone rubber is combined, which was found to be able to further improve the dispersion property of the dimethyl silicone rubber.

The silicone surfactant is preferably a nonion-based surface-active agent comprising a hydrophobic group configured by comprising dimethyl polysiloxane and a hydrophilic configured by comprising polyoxyalkylene. The silicone surfactant has configuration of siloxane skeleton, and therefore has a poor volatile property and is excellent in heat stability, accordingly is suitable to use for a fixing member to be used under a high temperature. In addition, it shows a solubility to a certain extent on an organic solvent in a ketone system capable of bringing the both of the fluoropolymer and the dimethyl silicone rubber into solution, and therefore can function as a surface-active agent of the both parties.

The silicone surfactant combined in the present invention, comprising a portion of dimethyl polysiloxane being hydrophobic provided with a high affinity with the dimethyl silicone rubber and a portion of polyoxyalkylene being hydrophilic provided with a affinity with the fluoropolymer, functions as a surface-active agent for the both parties and, accordingly, is considered to be capable of improving a dispersion property of the dimethyl silicone rubber.

Types of fluorocarbon rubber polymer (hereinafter also to be referred to as fluoropolymer) for use in the present invention will not be limited in particular, but vinylidene fluoride-tetrafluoroethylene-perfluoroalkylvinylether terpolymer is more preferable in the present invention, since vinylidene fluoride-tetrafluoroethylene-perfluoroalkylvinylether terpolymer having an ether group is considered to have a higher affinity with a polyoxyalkylene having an ether group of silicone surfactant than general vinylidene fluoride-hexafluoropropylene copolymer or vinylidene-hexafluoropropylene-tetrafluoroethylene terpolymer.

The silicone surfactant used in the present invention is preferably a chemical compound comprising a configuration described with the following chemical formulae (1) to (3).

That is, they are a side chain modification type silicone surfactant configured by comprising polyoxyalkylene combined to the side chain of dimethyl polysiloxane skeleton represented by Chemical Formula (1), an end chain modification type silicone surfactant configured by comprising polyoxyalkylene combined to the end of dimethyl polysiloxane skeleton represented by Chemical Formula (2), and a copolymer type silicone surfactant configured by repeated alternating combinations of dimethyl polysiloxane and polyoxyalkylen represented by Chemical Formula (3). Therein, the silicone surfactant of copolymer type described with the chemical formula (3) is more effective in dispersing the dimethyl silicone rubber to the fluoropolymer and is preferable. Here, in the chemical compound comprising the configuration described with the following chemical formulae (1) to (3), reference character R respectively and independently denotes a substituted or unsubstituted alkyl group, reference character R' respectively and independently denotes a substituted or unsubstituted alkylene group and reference characters a, b, m and n respectively and independently denote positive integers.

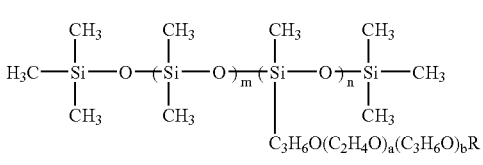

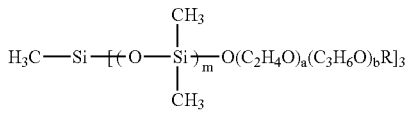

-continued (3)

$$RO(C_2H_4O)_a(C_3H_6O)_b\text{-}R'\text{-}\left[\begin{matrix}CH_3\\|\\Si\\|\\CH_3\end{matrix}\text{-}O\right]_m\text{-}\begin{matrix}CH_3\\|\\Si\\|\\CH_3\end{matrix}\text{-}R'O(C_2H_4O)_a(C_3H_6O)_b\text{-}R$$

The combining quantity of the silicone surfactant to fall within the range of 0.1 to 5.0% by weight to the sum of the fluorocarbon rubber and the dimethyl silicone rubber makes sufficient effects in improving the dispersion property and therefore is preferable.

Next, respective cross-linkings to the fluorocarbon rubber and the dimethyl silicone rubber will not be limited in particular, but bringing the both parties into cross-linking by an organic peroxide, they are brought into cross-linking on the interfaces of the continuous (sea) phase and the dispersion (island) phase so as to enable strength of the blended rubber to get intensified and be preferably capable of forming a rubber mold-releasing layer having excellent durability.

In particular, the fluorocarbon rubber is a type with iodine or bromine introduced into the molecule chain end or the side chain, and cross-linking by an organic peroxide is implemented by abstraction reaction of the iodine or bromine atom and a radical reaction to the allyl group of cross-linking auxiliary agent and the like. In addition, the dimethyl silicone rubber is a type with vinyl group introduced into the end of the dimethyl polysiloxane skeleton or the side chain, and cross-linking by an organic peroxide is implemented by a radical reaction to the vinyl group and the like. However, in the present invention, the surface layer formed by solution coating is brought into heating and cross-linking, and in case of cross-linking by an organic peroxide being a normal heating cross-linking such as an oven cross-linking and the like, oxygen existing in the air may hamper hardening work. In order to cut off the oxygen to result in hampered hardening, it is preferable to implement cross-linking by dipping into an oil, for example, silicone oil and fluorocarbon oil under a heated state. Silicone oil and fluorocarbon oil are excellent in heat resistance and suitable for use under a high temperature. Silicone oil can form a silicone polymer uppermost layer onto the fluorocarbon rubber by chemical bonding (Japanese Patent Application Laid-Open No. 2003-215969) and therefore is more favorable.

The fixing member comprising a rubber mold-releasing layer of the present invention can be manufactured as follows for example. At first, fluoropolymer configured by comprising vinylidene fluoride-tetrafluoroethylene-perfluoroalkylvinylether terpolymer containing iodine or bromine in molecules as reacting group, silicone polymer configured by comprising dimethylpolysiloxane containing vinyl group as reacting group at 50:50 in volume proportion, triallyl isocyanurate as cross-linking auxiliary agent at 4.0% by weight for the sum of fluoropolymer and silicone polymer, benzoyl peroxide being organic peroxide as cross-linking agent at 3.0% by weight, and silicone surfactant at 1.0% by weight were dissolved into a ketone system solvent to obtain a solution of ketone system. Well agitated ketone-related solution is coated onto the roller-shaped or the belt-shaped support (an elastic layer formed thereon in accordance with necessity) evenly in advance coated with a primer by blade coating and brought into drying. Thereafter the step goes to a primary cross-linking by dipping into a dimethyl silicone oil under a heated state to implement heating and through a secondary cross-linking step in an oven the fixing member can be manufactured. In the case where the elastic layer is configured by comprising a heat conductive silicone rubber, the cross-linking agent and the cross-linking auxiliary agent may move into the silicone rubber of the elastic layer to decrease the content in the mold-releasing layer, and therefore in the assumption of a moving quantity of cross-linking agent and the cross-linking auxiliary agent into the elastic layer silicone rubber, several times of combining more than the above described standard quantity is desirable. Here, a known primer layer may be used, and thickness thereof is not limited in particular, but normally around 1 to 10 μm.

Figure 2:
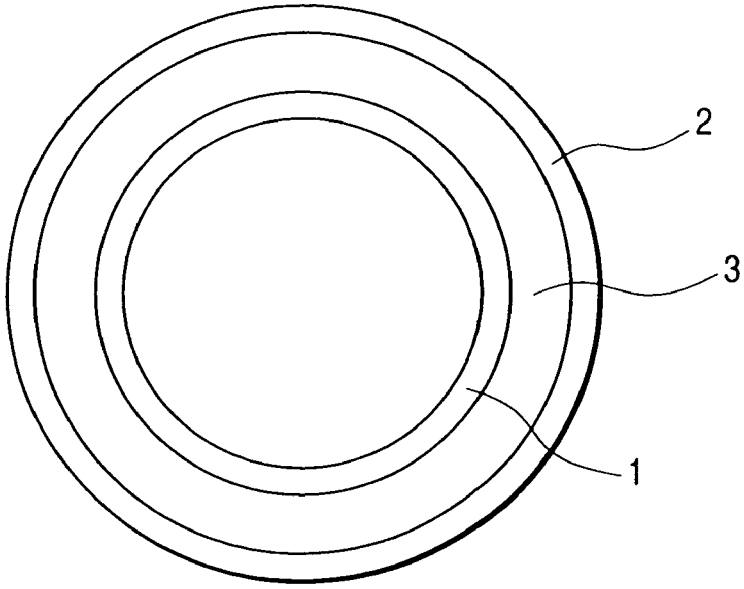
FIG. 2 is a sectional view of a fixing member in a double layer configuration.

A sectional view of a layer configuration of the fixing member obtained like this is shown in FIG. 1 (a single layer configuration) and in FIG. 2 (a double layer configuration).

In FIG. 1, on the upper surface of a roller-shaped or belt-shaped support 1, a rubber mold-releasing layer 2, which comprises a fluorocarbon rubber having a continuous phase (hereinafter also to be referred to as a sea phase) and a dimethyl silicone rubber having an island-shaped dispersion phase (hereinafter also to be referred to as a island phase), is formed and the average particle diameter of the dispersion phase in the sectional plane of the rubber mold-releasing layer is 20 μm or less.

Thickness of the rubber mold-releasing layer may be appropriately determined corresponding with necessity, and normally is preferably 10 μm or more in order to ensure sufficient scratch resistance and abrasion resistance. In addition, from the point of view of a heat conductive property and the like, thickness of 500 μm or less is desirable.

FIG. 2 relates to a fixing member in a double layer configuration, and on a roller-shaped or belt-shaped support 1, a heat conductive elastic layer 3 configured by comprising a conventional silicone rubber and the like is formed, and on this elastic body layer 3, a rubber mold-releasing layer 2 of the present invention is formed.

As a polymer type of a silicone rubber used here, polydimethyl siloxane, polymethylphenyl siloxane and the like can be nominated. The heat conductive elastic layer is preferably formed by bringing a heat conductive filler into combining with this. Such an elastic layer can be made by the known methods such as, for example, a method of injecting a silicone rubber material into inside a forming die to be brought into heat hardening, or a method of forming a silicone polymer layer by coating to be brought into hardening with a heating oven, etc. and the like.

The thickness of the heat conductive elastic layer is preferably 50 μm or more for such a reason to ensure the following property of paper and the like to a recording material such as paper, and is preferably 5 mm or less from the point of view of heat conductive property and the like.

In addition, in this case, too, likewise in case of the fixing member in a single layer configuration, thickness of the rubber mold-releasing layer may be appropriately determined as well, and its preferable range is likewise as well.

A fixing member of the present invention will not be limited to the fixing member in the above described single or double layer configuration, but may be in a multilayer configuration with triple layers or more, and its shape as well may be a fixing belt, a fixing roller, a pressure belt or a pressure roller and the like.

Next, the fixing apparatus of the present invention will be described.

The fixing apparatus of the present invention is a fixing apparatus used in an electrophotographic image forming apparatus, and the above described fixing member is disposed in form of a fixing belt or a fixing roller, and/or a pressure belt or a pressure roller. As an electrophotographic image forming apparatus, such an electrophotographic image forming apparatus comprising photosensitive member, latent image forming means, developing means for developing the formed latent image with a toner, a transferring means for transferring the developed toner image onto a transfer material, and fixing means for fixing the toner image on the transfer material and the like is nominated.

Figure 3:
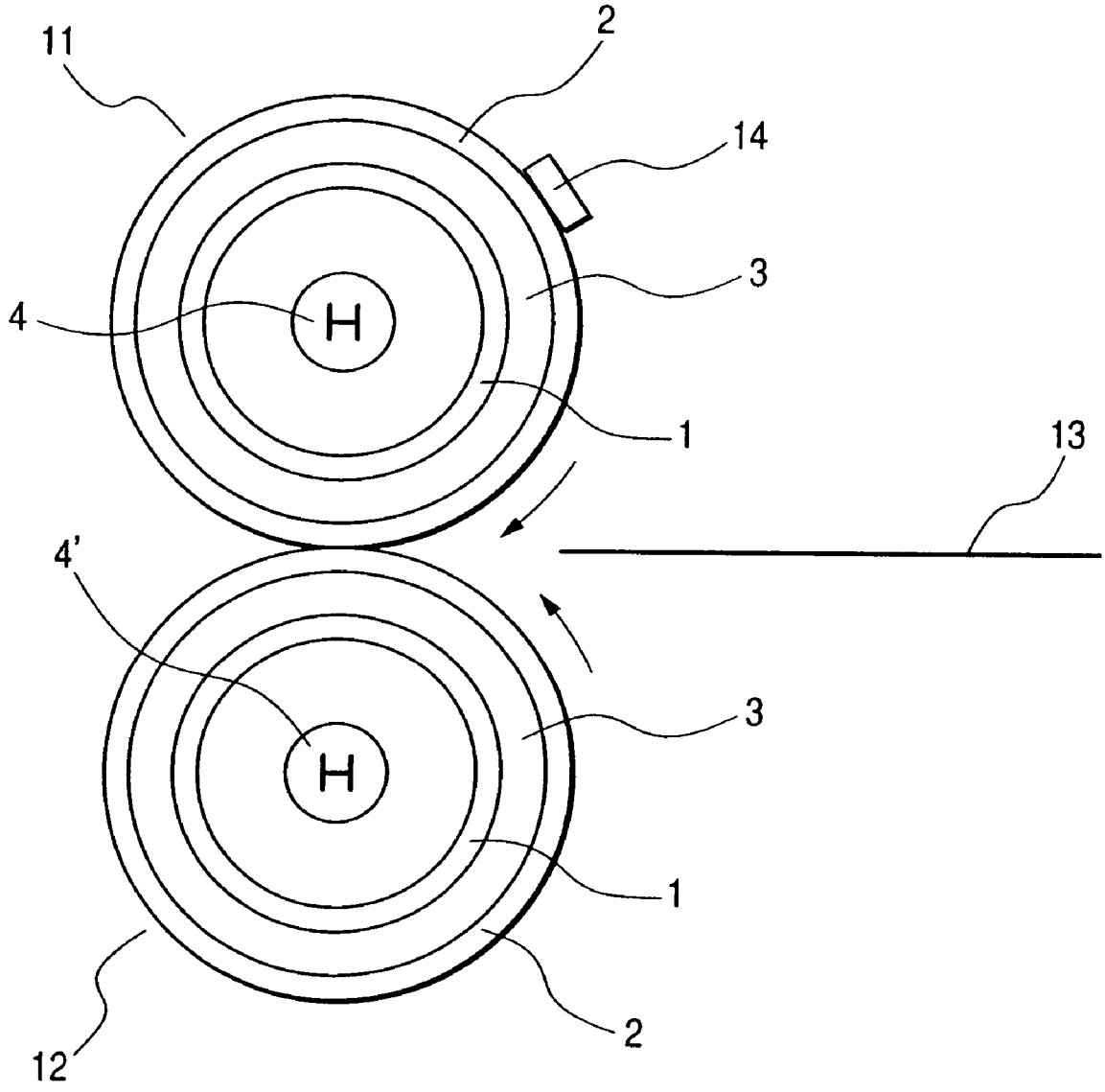
FIG. 3 is a schematic diagram of a mode of a fixing apparatus.

On an example of a fixing apparatus of the present invention, a schematic diagram is shown in FIG. 3.

The fixing apparatus comprising a fixing roller 11 being a roller disposed and described in the upper side in FIG. 3 and a pressure roller 12 being a roller disposed and described in the lower side. A fixing member of the present invention is used in at least either one of fixing roller 11 and pressure roller 12. In addition, heaters 4 and 4' configured by comprising, for example, halogen lamps are incorporated in the center of at least either one of fixing roller 11 and pressure roller 12.

The fixing roller 11 is rotary driven at a predetermined peripheral velocity in the direction of an arrow and the pressure roller 12 is rotary driven in the direction of an arrow in association therewith. In addition, the toner image formed on recording material 13 such as paper is fixed with heat from the heaters 4 and 4' and a nip pressure between the fixing roller 11 and the pressure roller 12.

The toner fixing temperature is kept at a setting temperature by controlling outputs from the heaters 4 and 4' based on the surface temperature of the fixing roller 11 measured by a thermistor 14. The surface temperature (fixing temperature) of the fixing roller 11 is not limited in particular, but normally is around 130 to 220° C.

Here, the fixing apparatus comprising a fixing and a pressure rollers was exemplified, and for the fixing apparatus of the present invention, the fixing member of the present invention will not be limited to the one shown in FIG. 3 but any one comprising a fixing belt or a fixing roller, and/or pressure belt or pressure roller will do.

EXAMPLES

The present invention will be described in detail by means of Examples as follows. Here, the present invention will not be limited anyhow with these examples.

The dispersion state of the fluorocarbon rubber and the dimethyl silicone rubber in the rubber mold-releasing layer was checked by using a scanning electro microscope and implementing elemental mapping with an electro probe microanalyzer (EPMA) (SEM, made by Nihon Denshi Co., JSM-5910LV type, acceleration voltage: 20 kV, measurement mode: high vacuum mode, measurement magnification: 300, detector: energy dispersion type (EDS) and mapping element: F and Si).

In addition, the volume ratio being the combining proportion of the fluorocarbon rubber to the dimethyl silicone rubber was calculated from respective combining quantities and the specific gravity of fluorocarbon rubber being 1.8 g/cm$^3$ and the specific gravity of dimethyl silicone rubber being 1.0 g/cm$^3$.

Here, the unfixed image of wax-containing toner was formed by removing the fixing apparatus from a color printer (LBP-2510) made by CANON and outputting images. Disposing the fixing apparatus (FIG. 3), in which the fixing member of the present invention was incorporated, in the above described LBP-2510, this unfixed image was brought into paper feeding under a condition of process speed 90 mm/sec and under the set fixing party surface temperature of 180° C. and thereby an image subject to fixing was obtained.

Example 1

90.0 g of fluoropolymer (product name: DAI-EL LT302, made by DAIKIN INDUSTRIES, LTD.) configured by comprising vinylidene fluoride-tetrafluoroethylene-perfluoromethylvinylether terpolymer containing iodine in molecules as reacting group, 50.0 g of silicone polymer configured by comprising dimethylpolysiloxane containing vinyl group as reacting group, 17.0 g of triallyl isocyanurate (product name: TAIC, made by Nihon Kasei CO., LTD) as cross-linking auxiliary agent, 11.0 g of benzoyl peroxide (product containing 25% water, made by Kishida Chemical Co., Ltd.) being organic peroxide as cross-linking agent, and 1.4 g of silicone surfactant (product name: FZ-2207, Nihon Unicar Co., Ltd.) of copolymer type configured by repeated alternating combinations of dimethyl polysiloxane and polyoxyalkylen, were dissolved into 525 ml of methyl isobutyl ketone being a ketone system solvent to obtain a solution of ketone system.

On an aluminum cylinder used as a support a heat conductive elastic layer configured by comprising silicone rubber with thickness of 1.5 mm is formed. A primer (product name: GLP-103SR, made by DAIKIN INDUSTRIES, ltd.) is evenly coated onto the surface of that heat conductive elastic layer in advance to give thickness of 1 μm and dried to obtain a roller (with an outer diameter of 3.5 mm). The outer periphery of that roller undergoes blade coating with well agitated ketone-related solution so as to give rise to a rubber mold-releasing layer with thickness subject to drying of 100 μm and the dried roller undergoes one hour dipping into a dimethyl silicone oil (product name: KF-96SS-300cs, made by Shin-Etsu Chemical Co., Ltd.) under 200° C. to implement the primary cross-linking. Next, subject to the secondary cross-linking in an oven (under 180° C. for 24 hours), the fixing member was finished.

This fixing member was used as a fixing roller 11 in a fixing apparatus (FIG. 3) being a mode of the present invention, and the unfixed image of wax-containing toner was brought into paper feeding to this fixing apparatus.

In addition, a sample for analysis of the above described mold-releasing layer rubber was formed and the dispersion mode in the surface and the sectional plane of this sample was checked. As a result, the both portions were configured by comprising the fluorocarbon rubber having the continuous phase and the dimethyl silicone rubber having the dispersion phase with island-like dispersion, and the average particle diameter of the dispersion phase in the sectional plane of the rubber mold-releasing layer was 20 μm. In addition, the average particle diameter of the dispersion phase in the surface of the rubber mold-releasing layer was 15 μm.

Example 2

In stead of implementing the primary cross-linking on the rubber used in the rubber mold-releasing layer by dipping into a dimethyl silicone oil under 200° C., the fixing member underwent one hour dipping into a fluorocarbon oil (product name: DEMNUM S-65, made by DAIKIN INDUSTRIES, ltd.) under 200° C. to be heated and otherwise likewise Example 1 a fixing member was finished.

This fixing member was used in as a fixing roller 11 in a fixing apparatus (FIG. 3) and the unfixed image of wax-containing toner was brought into paper feeding.

In addition, a sample for analysis of the above described mold-releasing layer rubber was formed and the dispersion mode in the surface and the sectional plane of this sample was checked. As a result, both portions were configured by comprising the fluorocarbon rubber having the continuous phase and the dimethyl silicone rubber having the dispersion phase, and the average particle diameter of the dispersion phase in the sectional plane of the rubber mold-releasing layer was 2-0 μm. In addition, the average particle diameter of the dispersion phase in the surface of the rubber mold-releasing layer was 15 μm.

Example 3

With 36.0 g of fluoropolymer, 80.0 g of silicone polymer, 14.0 g of triallyl isocyanurate, 9.3 g of benzoyl peroxide, 1.2 g of silicone surfactant and 435 ml of methyl isobutyl ketone, a ketone system solution was obtained and otherwise likewise Example 2 a fixing member was finished.

This fixing member was used in as a fixing roller 11 in a fixing apparatus (FIG. 3) and the unfixed image of wax-containing toner was brought into paper feeding.

In addition, a sample for analysis of the above described mold-releasing layer rubber was formed and the dispersion mode in the surface and the sectional plane of this sample was checked. As a result, both portions were configured by comprising the fluorocarbon rubber having the continuous phase and the dimethyl silicone rubber having the dispersion phase, and the average particle diameter of the dispersion phase in the sectional plane of the rubber mold-releasing layer was 20 μm. In addition, the average particle diameter of the dispersion phase in the surface of the rubber mold-releasing layer was 20 μm.

Example 4

With 144.0 g of fluoropolymer, 20.0 g of silicone polymer, 19.7 g of triallyl isocyanurate, 13.1 g of benzoyl peroxide, 1.6 g of silicone surfactant and 615 ml of methyl isobutyl ketone, a ketone system solution was obtained and otherwise likewise Example 2 a fixing member was finished.

This fixing member was used in as a fixing roller 11 in a fixing apparatus (FIG. 3) and the unfixed image of wax-containing toner was brought into paper feeding.

In addition, a sample for analysis of the above described mold-releasing layer rubber was formed and the dispersion mode in the surface and the sectional plane of this sample was checked. As a result, the both portions were configured by comprising the fluorocarbon rubber having the continuous phase and the dimethyl silicone rubber having the dispersion phase, and the average particle diameter of the dispersion phase in the sectional plane of the rubber mold-releasing layer was 20 μm. In addition, the average particle diameter of the dispersion phase in the surface of the rubber mold-releasing layer was 15 μm.

Comparative Example 1

With 18.0 g of fluoropolymer, 90.0 g of silicone polymer, 13.0 g of triallyl isocyanurate, 8.6 g of benzoyl peroxide, 1.1 g of silicone surfactant and 405 ml of methyl isobutyl ketone, a ketone system solution was obtained and otherwise likewise Example 2 a fixing member was finished.

This fixing member was used as a fixing roller 11 in a fixing apparatus (FIG. 3), and the unfixed image of wax-containing toner was brought into paper feeding to this fixing apparatus.

In addition, a sample for analysis of the above described mold-releasing layer rubber is formed and the dispersion mode in the surface and the sectional plane of this sample was checked. As a result, the sectional plane was configured by comprising the fluorocarbon rubber having the continuous phase and the dimethyl silicone rubber having the dispersion phase, and the average particle diameter of the dispersion phase in the sectional plane of the rubber mold-releasing layer was 40 μm. In addition, the average particle diameter of the dispersion phase in the surface of the rubber mold-releasing layer was 25 μm.

Comparative Example 2

With 162.0 g of fluoropolymer, 10.0 g of silicone polymer, 20.6 g of triallyl isocyanurate, 13.8 g of benzoyl peroxide, and 645 ml of methyl isobutyl ketone, a ketone system solution was obtained and otherwise likewise Example 2 a fixing member was finished. This fixing member was used as a fixing roller 11 in a fixing apparatus (FIG. 3), and the unfixed image of wax-containing toner was brought into paper feeding to this fixing apparatus.

In addition, a sample for analysis of the above described mold-releasing layer rubber was formed and the dispersion mode in the surface and the sectional plane of this sample was checked. As a result, both portions were configured by comprising the fluorocarbon rubber having the continuous phase and the dimethyl silicone rubber having the dispersion phase, and the average particle diameter of the dispersion phase in the sectional plane of the rubber mold-releasing layer was 20 μm. In addition, the average particle diameter of the dispersion phase in the surface of the rubber mold-releasing layer was 15 μm.

Comparative Example 3

Except that silicone surfactant was not combined, likewise Example 2 a fixing member was finished.

This fixing member was used as a fixing roller 11 in a fixing apparatus (FIG. 3), and the unfixed image of wax-containing toner was brought into paper feeding to this fixing apparatus.

In addition, a sample for analysis of the above described mold-releasing layer rubber was formed and the dispersion mode in the surface and the sectional plane of this sample was checked. As a result, the sectional plane was configured by comprising the fluorocarbon rubber having the continuous phase and the dimethyl silicone rubber having the dispersion phase, but the surface comprised only fluorocarbon rubber. The average particle diameter of the dispersion phase in the sectional plane of the rubber mold-releasing layer was 80 μm.

Combining proportions and the like for Examples 1 to 4 as well as Comparative Examples 1 to 3 are shown in Table 1.

TABLE 1

| | Combining proportion (volume ratio) | | Silicone surfactant | |
|---|---|---|---|---|
| | Fluorocarbon rubber | Silicone rubber | (Sum for rubber) | Primary cross-linking method |
| Example 1 | 50 | 50 | 1% by weight | silicone oil dipping |
| Example 2 | 50 | 50 | 1% by weight | fluorocarbon oil dipping |

TABLE 1-continued

| | Combining proportion (volume ratio) | | Silicone surfactant | |
|---|---|---|---|---|
| | Fluorocarbon rubber | Silicone rubber | (Sum for rubber) | Primary cross-linking method |
| Example 3 | 20 | 80 | 1% by weight | fluorocarbon oil dipping |
| Example 4 | 80 | 20 | 1% by weight | fluorocarbon oil dipping |
| Comparative Example 1 | 10 | 90 | 1% by weight | fluorocarbon oil dipping |
| Comparative Example 2 | 90 | 10 | 1% by weight | fluorocarbon oil dipping |
| Comparative Example 3 | 50 | 50 | None | fluorocarbon oil dipping |

Next, assessment results for Examples 1 to 4 as well as Comparative Examples 1 to 3 are shown in Table 2.

On the other hand, with regard to Comparative Example 1, the combining portion of the dimethyl silicone rubber was large, and the both of surface and sectional plan of the rubber mold-releasing layer were con figured by comprising the fluorocarbon rubber having a continuous phase and a dimethyl silicone rubber having a dispersion (island) phase, but the average particle diameter of the dispersion phase in the both of surface and sectional plane of the rubber mold-releasing layer were over 20 μm. And with fixing apparatus comprising this fixing member used as a fixing roller, the unfixed image of wax-containing toner was brought into paper feeding, resulting in a poor toner mold-releasing property, and at the point of time when 100 sheets were brought into paper feeding, image lacking due to toner offset occuffed in the image subject to fixing, which failed in satisfying the fixing performance. Next, with regard to Comparative Example 2, both of the surface and sectional plane of the rubber mold-releasing layer were configured by comprising the fluorocarbon rubber having a continuous

TABLE 2

| | Surface dispersion state | | | Sectional plane dispersion state | |
|---|---|---|---|---|---|
| | Fluorocarbon rubber | Silicone rubber | Average particle diameter | Average particle diameter | Toner mold-releasing property* |
| Example 1 | Continuous phase | Dispersion (island) phase | 15 μm | 20 μm | Early period OK and durability OK |
| Example 2 | Continuous phase | Dispersion (island) phase | 15 μm | 20 μm | Early period OK and durability OK |
| Example 3 | Continuous phase | Dispersion (island) phase | 20 μm | 20 μm | Early period OK and durability OK |
| Example 4 | Continuous phase | Dispersion (island) phase | 15 μm | 20 μm | Early period OK and durability OK |
| Comparative Example 1 | Continuous phase | Dispersion (island) phase | 25 μm | 40 μm | Early period OK and durability NG |
| Comparative Example 2 | Continuous phase | Dispersion (island) phase | 15 μm | 20 μm | Early period NG |
| Comparative Example 3 | Only fluorocarbon rubber | | | 80 μm | Early period NG |

*Early period OK and durability OK: 10000 sheet paper feeding cleared, Early period OK and durability NG: 100 sheet paper feeding with occurrence of toner offset, Early period NG: occurrence of toner offset or paper twining for the first sheet For Examples 1 to 4, the combining proportion of the fluorocarbon rubber (A) to the dimethyl silicone rubber (B) fell within the range of (A): (B)=20:80 to 80:20 in terms of the volume ration, and, both of the surface and sectional plane of the rubber mold-releasing layer were configured by comprising a fluorocarbon rubber having a continuous phase and a dimethyl silicone rubber having a dispersion (island) phase, and the average particle diameter of the dispersion phase in the both of surface and sectional plane of the rubber mold-releasing layer is 20 μm or less. And with fixing apparatus comprising this fixing member used as a fixing roller, the unfixed image of was-containing toner was brought into paper feeding, resulting in a good toner mold-releasing property, and even at the point of time when 10000 sheets were brought into paper feeding, no image lacking due to toner offset was observed in the image subject to fixing. In addition, a toner image at the point of time when 10000 sheets were brought into paper feeding comprised a high image quality.

phase and the dimethyl silicone rubber having a dispersion (island) phase, and the average particle diameter of the dispersion phase in the both of surface and sectional plane of the rubber mold-releasing layer were 20 μm or less, but the combining portion of the dimethyl silicon rubber was 10% by volume, being less compared with Examples 1 to 4. With fixing apparatus comprising this fixing member used as a fixing roller, the unfixed image of wax-containing toner was brought into paper feeding, resulting in a poor toner mold-releasing property, and for the first sheet, image lacking due to toner offset occurred in the image subject to fixing, which failed in satisfying the fixing performance. In addition, with regard to Comparative Example 3, in the surface of the rubber mold-releasing layer, no dimethyl silicone rubber, and the average particle diameter of the dispersion phase in the sectional plane of the rubber mold-releasing layer was 80 μm, and in wax-containing toner unfixed image paper feeding test in the case where this fixing member was incorporated in the fixing apparatus, the toner mold-releasing property was found to be insufficient further than at the time of Comparative Example 1, having caused paper twining, that took place as a result of unseparation of toner from the mold-releasing layer, from the very first sheet.

This application claims priority from Japanese Patent Application No. 2004-203552 filed on Jul. 9, 2004, which is hereby incorporated by reference herein.

What is claimed is:

1. A fixing member comprising a support and a surface layer, wherein the surface layer is a rubber mold-releasing layer containing a mixture of a fluorocarbon rubber and a dimethyl silicone rubber, the rubber mold-releasing layer comprises an island phase consisting of the dimethyl silicone rubber which has been cross-linked with a three-dimensional network, and a sea phase consisting of the fluorocarbon rubber, the island phase is a dispersion phase and the sea phase is a continuous phase, an average particle diameter of the island phase in the sectional plane of the rubber mold-releasing layer is 20 μm or less, and the combining proportion of the fluorocarbon rubber to the dimethyl silicone rubber falls within a range of 20:80 to 80:20 in terms of a volume proportion.

2. The fixing member according to claim 1, wherein the fluorocarbon ruber is a vinylidene fluoride-tetrafluoroethylene-peffluoroalkylvinylether terpolymer.

3. The fixing member according to claim 1, wherein the rubber mold-releasing layer further contains a silicone surfactant.

4. The fixing member according to claim 3, wherein the silicone surfactant has a polydimethyl siloxane unit and a polyoxyalkylen unit, and the polydimethyl siloxane unit and the polyoxyalkylen unit are alternately repeated.

5. The fixing member according to claim 3, wherein a combining quantity of the silicone surfactant is 0.1% by weight to 5.0% by weight to the summed weight of the fluorocarbon ruber and the dimethyl silicone rubber.

6. The fixing member according to claim 1, wherein both of the fluorocarbon rubber and the dimethyl silicone rubber in the rubber mold-releasing layer are subject to cross-linking by an organic peroxide.

7. The fixing member according to claim 6, wherein the cross-linking by the organic peroxide is implemented simultaneously to the fluorocarbon rubber and the dimethyl silicon rubber.

8. The fixing member according to claim 1, wherein the fixing member is a fixing roller.

9. The fixing member according to claim 1, wherein the fixing member is a fixing belt.

10. A fixing apparatus in an oilless system comprising a fixing member according to claim 1.

11. The fixing apparatus according to claim 10, wherein the fixing member is a fixing roller.

12. The fixing apparatus according to claim 10, wherein the fixing member is a fixing belt.

13. The fixing apparatus according to claim 10, wherein the fixing member comprises a fixing roller and a pressure roller.

14. A fixing method in an oilless system comprising fixing a toner image onto a surface of a transfer material by a fixing apparatus according to claim 10.

15. The fixing method according to claim 14, wherein the fixing member is a fixing roller.

16. The fixing method according to claim 14, wherein the fixing member is a fixing belt.

17. The fixing method according to claim 14, wherein the fixing member comprises a fixing roller and a pressure roller.

* * * * *

UNITED STATES PATENT AND TRADEMARK OFFICE

CERTIFICATE OF CORRECTION

PATENT NO. : 7,359,669 B2
APPLICATION NO. : 11/169788
DATED : April 15, 2008
INVENTOR(S) : Yuji Kitano It is certified that error appears in the above-identified patent and that said Letters Patent is hereby corrected as shown below:

ON THE TITLE PAGE

At Item (56) Foreign Patent Documents, "06308848" should read --06-308848-- and "09096981" should read --09-096981--.

At Item (56), Other Publications, "Organics Chemistry" should read --Organic Chemistry--.

COLUMN 2

Line 65, "outest" should read --outermost--.

COLUMN 5

Line 59, "having a" should read --having an--.

COLUMN 6

Line 14, "with a" should read --with an--.

COLUMN 8

Line 22, "as a" should read --as an--.

COLUMN 10

Line 44, "mold-releasing layer rubber" should read --rubber mold-releasing layer--.
Line 58, "In stead" should read --Instead--.

COLUMN 11

Line 9, "2-0μm." should read --20μm.--.
Line 20, "used in" should read --used--.
Line 24, "layer rubber" should read --rubber layer--.
Line 42, "used in" should read --used--.
Line 46, "layer rubber" should read --rubber layer--.

UNITED STATES PATENT AND TRADEMARK OFFICE

CERTIFICATE OF CORRECTION

PATENT NO. : 7,359,669 B2
APPLICATION NO. : 11/169788
DATED : April 15, 2008
INVENTOR(S) : Yuji Kitano It is certified that error appears in the above-identified patent and that said Letters Patent is hereby corrected as shown below:

COLUMN 12
Line 2, “layer rubber” should read --rubber layer--.
Line 19, “This” be at the start of a new paragraph.
Line 24, “layer rubber” should read --rubber layer--.
Line 44, “layer rubber” should read --rubber layer--.

COLUMN 14
Line 3, “plan” should read --plane--.
Line 15, “occuffed” should read --occurred--.

COLUMN 15
Line 27, “ruber” should read --rubber--.
Lines 27 and 28, “fluoride-tetrafluoroethylene-peffluoroalkylvinylether” should read --fluoride-tetrafluoroethylene-perfluoroalkylvinylether--.

Signed and Sealed this

Twenty-fourth Day of February, 2009

JOHN DOLL
*Acting Director of the United States Patent and Trademark Office*